US007772814B2

(12) United States Patent
Suematsu et al.

(10) Patent No.: US 7,772,814 B2
(45) Date of Patent: Aug. 10, 2010

(54) STEP-DOWN CIRCUIT

(75) Inventors: Yasuhiro Suematsu, Yokohama (JP); Katsumi Abe, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 394 days.

(21) Appl. No.: 11/971,579

(22) Filed: Jan. 9, 2008

(65) Prior Publication Data

US 2008/0211469 A1 Sep. 4, 2008

(30) Foreign Application Priority Data

Jan. 11, 2007 (JP) ..... 2007-003525

(51) Int. Cl.
*G05F 1/565* (2006.01)
*G05F 1/40* (2006.01)

(52) U.S. Cl. ..... 323/275; 323/280

(58) Field of Classification Search ..... 323/269, 323/273–275, 280

See application file for complete search history.

(56) References Cited

U.S. PATENT DOCUMENTS 5,281,869 A * 1/1994 Lundberg ..... 326/21
6,420,857 B2 * 7/2002 Fukui ..... 323/280
6,469,480 B2 10/2002 Kanakubo
7,142,044 B2 11/2006 Sano
7,397,227 B2 * 7/2008 Ke et al. ..... 323/273

FOREIGN PATENT DOCUMENTS

JP 2005-107948 4/2005

* cited by examiner

*Primary Examiner*—Jessica Han
(74) *Attorney, Agent, or Firm*—Oblon, Spivak, McClelland, Maier & Neustadt, L.L.P.

(57) ABSTRACT

A step-down circuit generates a second power supply lower than a first power supply. The step-down circuit includes an output terminal connected to a load circuit, an output transistor connected between the first power supply and the output terminal, and having a gate terminal connected to a first node, a monitor transistor connected between the first power supply and a second node, and having a gate terminal connected to the first node, and a feedback circuit which sets a gate voltage of the output transistor in accordance with a difference between a voltage obtained by dividing a voltage of the second node and a reference voltage. A size of the monitor transistor is changed in accordance with an operation mode of the load circuit.

17 Claims, 5 Drawing Sheets

STEP-DOWN CIRCUIT

CROSS-REFERENCE TO RELATED APPLICATIONS

This application is based upon and claims the benefit of priority from prior Japanese Patent Application No. 2007-003525, filed Jan. 11, 2007, the entire contents of which are incorporated herein by reference.

BACKGROUND OF THE INVENTION

1. Field of the Invention

The present invention relates to a step-down circuit and, more particularly, to a step-down circuit that generates an internal power supply voltage by stepping down an external power supply voltage.

2. Description of the Related Art

A step-down circuit that generates an internal power supply voltage by stepping down an external power supply voltage is known. This step-down circuit comprises an output transistor connected between an external power supply and a load circuit that receives the internal power supply voltage, and a circuit for setting the gate voltage of this output transistor.

As the micropatterning of semiconductor products advances, it is becoming necessary to step down the power supply voltage in order to secure the reliability of devices. When an external power supply voltage and internal power supply voltage are stepped down, the potential difference between the two power supply voltages decreases. This decreases a drain-to-source voltage Vds of the output transistor included in the step-down circuit, and reduces a load current flowing through the load circuit that receives the internal power supply voltage. Accordingly, a metal oxide semiconductor (MOS) transistor having high current supply capability is generally required as the output transistor.

The gate voltage of the output transistor is always held constant regardless of the load current. Therefore, the internal power supply voltage fluctuates in accordance with the load current. Although the fluctuation amount of the load current changes in accordance with the specifications of the product, the fluctuation is produced because the internal circuit operations of the device in operation modes roughly classified into a data write mode, a data read mode, and another function mode are largely different. The fluctuation in internal power supply voltage makes the circuit operation unstable, and affects the operation timings and current specifications. This problem cannot be ignored any longer if stepping down the voltage and raising the speed of a device further advance in the future.

As a related technique of this kind, a technique is disclosed which changes the size of an output transistor for applying a voltage to a load circuit, thereby changing the current supply capability of the output transistor in accordance with a load current (Jpn. Pat. Appln. KOKAI Publication No. 2005-107948).

BRIEF SUMMARY OF THE INVENTION

According to an aspect of the present invention, there is provided a step-down circuit which generates a second power supply lower than a first power supply, comprising:

an output terminal connected to a load circuit;

an output transistor connected between the first power supply and the output terminal, and having a gate terminal connected to a first node;

a monitor transistor connected between the first power supply and a second node, and having a gate terminal connected to the first node; and a feedback circuit which sets a gate voltage of the output transistor in accordance with a difference between a voltage obtained by dividing a voltage of the second node and a reference voltage, wherein a size of the monitor transistor is changed in accordance with an operation mode of the load circuit.

DETAILED DESCRIPTION OF THE INVENTION

Embodiments of the present invention will be explained below with reference to the accompanying drawing. Note that in the following explanation, the same reference numbers denote elements having the same functions and arrangements, and a repetitive explanation will be made only when necessary.

First Embodiment

Figure 1:
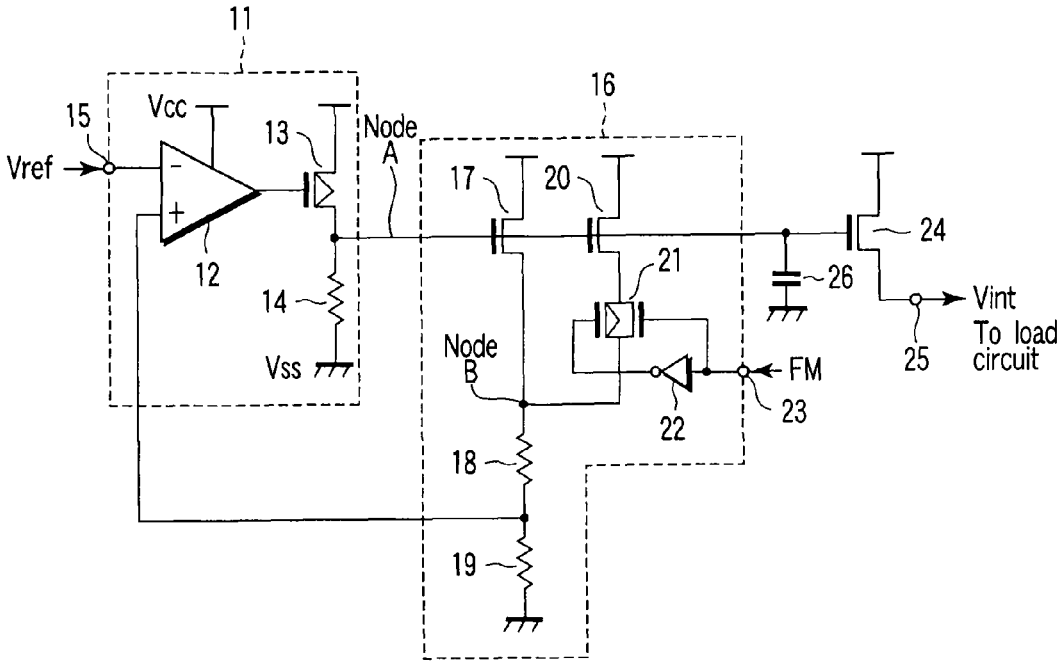
FIG. 1 is a circuit diagram illustrating the configuration of a step-down circuit according to the first embodiment of the present invention.

FIG. 1 is a circuit diagram illustrating the configuration of a step-down circuit according to the first embodiment of the present invention. This step-down circuit comprises a feedback circuit 11, monitor circuit 16, and output transistor 24.

The output transistor 24 is a MOS transistor, e.g., an N-channel MOS transistor having current drivability higher than that of a P-channel MOS transistor. An external power supply voltage Vcc is applied to the drain terminal of the output transistor 24. The gate terminal of the output transistor 24 is connected to node A. The source terminal of the output transistor 24 is connected to an output terminal 25. That is, the output transistor 24 is a source follower. An internal power supply voltage Vint obtained by stepping down the external power supply voltage Vcc is output from the output terminal 25 to an external circuit. The output terminal 25 is connected to a load circuit to which the internal power supply voltage Vint is applied.

The monitor circuit 16 monitors the state of the output transistor 24, and generates a voltage equal to the internal power supply voltage Vint applied from the output transistor 24. Also, the monitor circuit 16 adjusts the voltage of node A (the gate voltage of the output transistor 24). The monitor circuit 16 comprises an N-channel MOS (NMOS) transistor 17, resistors 18 and 19, an NMOS transistor 20, a transfer gate 21 as a switching element, and an inverter circuit 22.

NMOS transistors 17 and 20 are source followers. More specifically, the external power supply voltage Vcc is applied to the drain terminal of NMOS transistor 17. The gate terminal of NMOS transistor 17 is connected to node A. The source terminal of NMOS transistor 17 is connected to one terminal of resistor 18 via node B. The other terminal of resistor 18 is connected to one terminal of resistor 19. A ground voltage Vss is applied to the other terminal of resistor 19.

NMOS transistor 20 is connected in parallel to NMOS transistor 17. The external power supply voltage Vcc is applied to the drain terminal of NMOS transistor 20. The gate terminal of NMOS transistor 20 is connected to node A. The source terminal of NMOS transistor 20 is connected to one terminal of the transfer gate 21. The other terminal of the transfer gate 21 is connected to node B. The transfer gate 21 is formed by connecting a P-channel MOS (PMOS) transistor and NMOS transistor in parallel.

The monitor circuit 16 receives, via a terminal 23, a switching signal FM for switching the operation modes of the load circuit. The switching signal FM is supplied from the load circuit or a circuit that controls the load circuit. Examples of the operation modes are a data write operation, a data read operation, and another function mode. When switching the data write operation to the data read operation or vice versa, for example, a write enable signal or read enable signal is used as the switching signal FM.

The switching signal FM is input to the transfer gate 21. More specifically, the switching signal FM is input to the gate terminal of the NMOS transistor of the transfer gate 21. Also, an inverted signal obtained by inverting the switching signal FM by the inverter circuit 22 is input to the gate terminal of the PMOS transistor of the transfer gate 21. Therefore, the transfer gate 21 is on when the switching signal FM is high, and is off when the switching signal FM is low.

The feedback circuit 11 comprises a differential amplifier 12, PMOS transistor 13, and resistor 14. A reference voltage Vref is applied to the feedback circuit 11 via a terminal 15. The reference voltage Vref is applied to the negative input terminal of the differential amplifier 12. The positive input terminal of the differential amplifier 12 is connected between resistors 18 and 19. The differential amplifier 12 amplifies the difference between the two input voltages, and outputs the amplified voltage. The external power supply voltage Vcc is applied to the power supply terminal of the differential amplifier 12.

The output terminal of the differential amplifier 12 is connected to the gate terminal of the PMOS transistor 13. The external power supply voltage Vcc is applied to the source terminal of the PMOS transistor 13. The drain terminal of the PMOS transistor 13 is connected to node A and one terminal of resistor 14. The other terminal of resistor 14 is grounded (the ground voltage Vss is applied to the other terminal of resistor 14).

The step-down circuit has a capacitor 26 for stabilizing the voltage of node A. One electrode of the capacitor 26 is connected to node A. The other electrode of the capacitor 26 is grounded.

The operation of the step-down circuit configured as above will be explained below. When the external power supply voltage Vcc and reference voltage Vref are applied to the step-down circuit, NMOS transistor 17 sets the voltage of node B in accordance with the voltage of node A. Node B is set at a voltage equal to the internal power supply voltage Vint. The case where the internal power supply voltage Vint is set at 1.8V and the reference voltage Vref is set at 1.2V will be explained as an example. The external power supply voltage Vcc is set at, e.g., 3V that is higher than the internal power supply voltage Vint. Letting R1 be the resistance value of resistor 18 and R2 be the resistance value of resistor 19, the ratio of R1:R2 is set at 1:2.

A divisional voltage obtained by dividing the voltage of node B by resistors 18 and 19 is applied to the positive input terminal of the differential amplifier 12. On the basis of the difference between the two input voltages, the differential amplifier 12 sets the gate voltage of the PMOS transistor 13. In this case, node B is set at about 1.8V equal to the internal power supply voltage Vint, and the divisional voltage is set at about 1.2V. Since this control sets node A at a predetermined voltage, the internal power supply voltage Vint is applied from the output terminal 25 to the load circuit.

The monitor circuit 16 has one or a plurality of NMOS transistors (in this embodiment, NMOS transistor 20) having a gate terminal connected to node A, in addition to NMOS transistor 17. The monitor circuit 16 is configured to change the size (i.e., the gate [channel] width) of the NMOS transistor whose gate terminal is connected to node A, in accordance with the operation mode of the load circuit.

More specifically, in an operation mode in which the load current (current consumption) flowing through the load circuit is large, the switching signal FM is made low. Since this electrically disconnects NMOS transistor 20 from node B, NMOS transistor 17 is the only NMOS transistor connected to node B. That is, the size of the NMOS transistor for adjusting the voltage of node A (the NMOS transistor connected to nodes A and B) decreases. Since the drain current of the NMOS transistor is constant, the voltage of node A rises. Accordingly, the output transistor 24 decreases the ON resistance, and increases the current supply capability.

On the other hand, in an operation mode in which the load current (current consumption) flowing through the load circuit is small, the switching signal FM is made high. As a consequence, the two NMOS transistors 17 and 20 are electrically connected to node B. That is, the size of the NMOS transistor for adjusting the voltage of node A increases. Since the drain current of the NMOS transistor is constant, the voltage of node A lowers. Therefore, the output transistor 24 increases the on resistance, and decreases the current supply capability.

By thus configuring the monitor circuit 16, it is possible to obtain the same effect as changing the size of the NMOS transistor connected to node A. Consequently, the amount of fluctuation in internal power supply voltage Vint caused by the operation mode of the load circuit can be reduced.

The layouts of the NMOS transistors used in the step-down circuit will be explained below. NMOS transistors 17 and 20 included in the monitor circuit 16 are used to adjust the voltage of node A, so their current supply capability is set low. That is, small-sized NMOS transistors are used as NMOS transistors 17 and 20.

On the other hand, the current supply capability of the output transistor 24 is set high because it is necessary to supply a large electric current to the load circuit connected to the output terminal 25. That is, a large-sized MOS transistor is used as the output transistor 24. In this embodiment, therefore, the output transistor 24 comprises a plurality of NMOS transistors, and the size of each NMOS transistor is made equal to that of NMOS transistor 17 (or 20).

Figure 2:
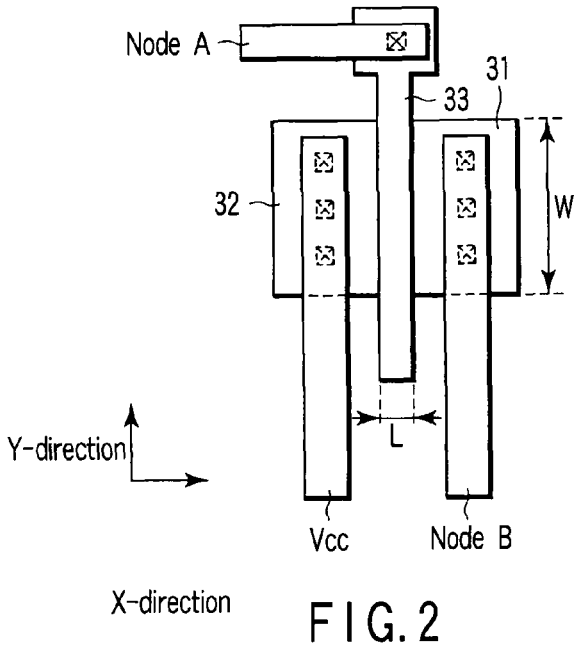
FIG. 2 is a view illustrating the layout of an NMOS transistor 17.

First, the layout of the NMOS transistors included in the monitor circuit 16 will be explained. NMOS transistors 17 and 20 included in the monitor circuit 16 have the same layout. That is, a gate width W (channel width), a gate length L (channel length), and the size of an $N^+$-type diffusion region as a source/drain region of NMOS transistor 17 are set equal to those of NMOS transistor 20. FIG. 2 is a view illustrating the layout of NMOS transistor 17 (or 20).

A source region 31 and drain region 32 are formed in a P-type semiconductor substrate (or P-type well). The source region 31 and drain region 32 are $N^+$-type diffusion regions formed by heavily doping an $N^+$-type impurity. A gate electrode 33 is formed on a gate insulating film on the P-type semiconductor substrate between the source region 31 and drain region 32. The gate width and gate length of NMOS transistor 17 are respectively set at W and L. The channel width direction of NMOS transistor 17 is the Y-direction. The channel length direction of NMOS transistor 17 is the X-direction.

The gate electrode 33 is connected to node A via a contact. The source region 31 is connected to node B via a contact. The drain region 32 is connected, via a contact, to an interconnection to which the external power supply voltage Vcc is applied. NMOS transistor 17 is thus configured. The layout of NMOS transistor 20 is the same as that of FIG. 2.

Figure 3:
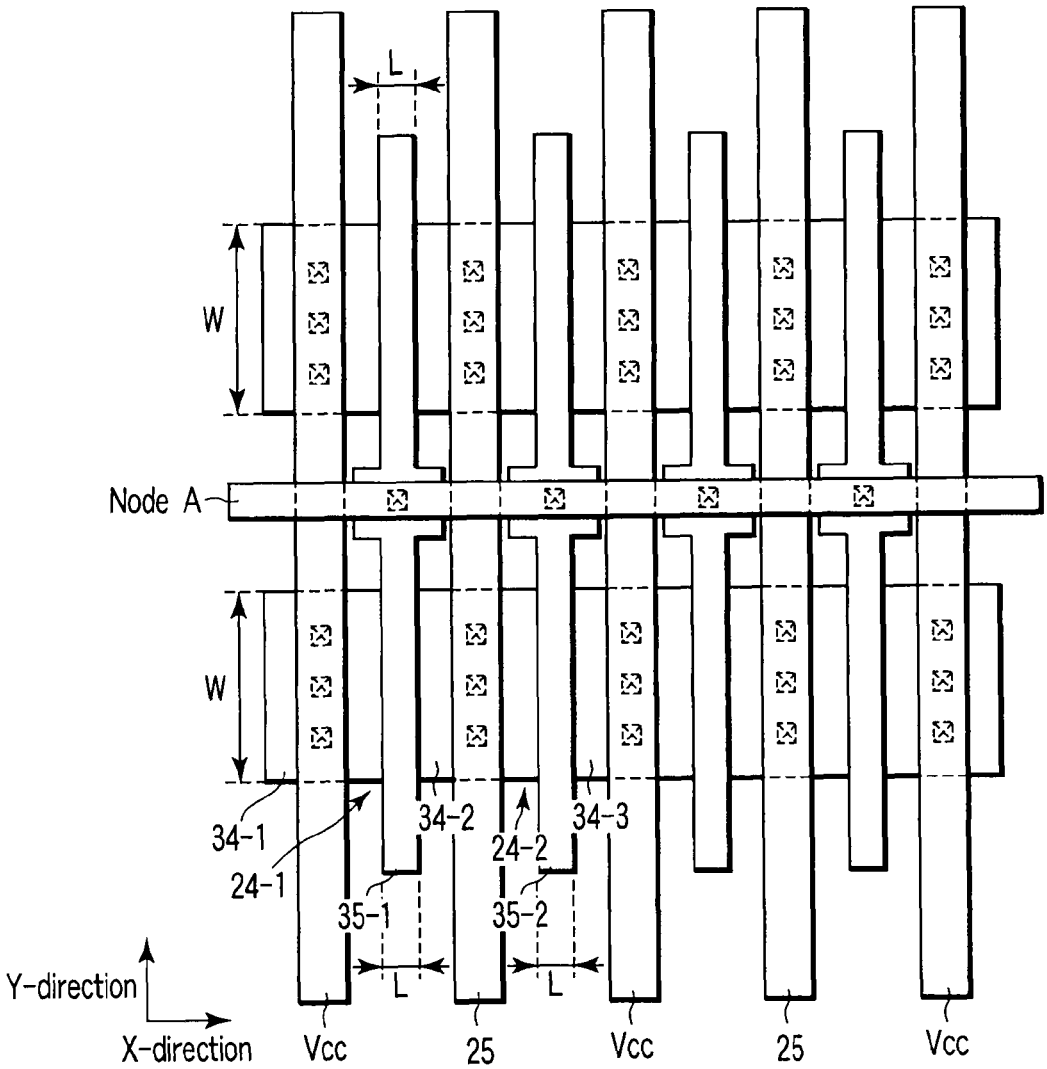
FIG. 3 is a view illustrating the layout of a part of an output transistor 24.

Next, the layout of the output transistor 24 will be explained. FIG. 3 is a view illustrating the layout of a part of the output transistor 24. The output transistor 24 comprises a plurality of NMOS transistors connected in parallel to each other and each being the same size as NMOS transistor 17 (or 20). The number of the NMOS transistors forming the output transistor 24 is determined on the basis of the load current flowing through the load circuit.

As shown in FIG. 3, a source region 34-2 and drain region 34-1 made of $N^+$-type diffusion regions are formed in a P-type semiconductor substrate (or P-type well). A gate electrode 35-1 is formed on a gate insulating film on the P-type semiconductor substrate between the source region 34-2 and drain region 34-1.

The gate electrode 35-1 is connected to node A via a contact. The source region 34-2 is connected to the output terminal 25 via a contact. The drain region 34-1 is connected, via a contact, to an interconnection to which the external power supply voltage Vcc is applied. An NMOS transistor 24-1 of the NMOS transistors forming the output transistor 24 is thus configured. The channel width direction of NMOS transistor 24-1 is the Y-direction. The channel length direction of NMOS transistor 24-1 is the X-direction.

Also, a drain region 34-3 made of an $N^+$-type diffusion region is formed in the P-type semiconductor substrate. A gate electrode 35-2 is formed on a gate insulating film on the P-type semiconductor substrate between the source region 34-2 and drain region 34-3. The gate electrode 35-2 is connected to node A via a contact. The drain region 34-3 is connected, via a contact, an interconnection to which the external power supply voltage Vcc is applied. An NMOS transistor 24-2 of the NMOS transistors forming the output transistor 24 is thus configured. The channel width direction of NMOS transistor 24-2 is the Y-direction. The channel length direction of NMOS transistor 24-2 is the X-direction.

Similarly, as shown in FIG. 3, a plurality of NMOS transistors are formed in the X- and Y-directions of NMOS transistor 24-1 so as to be connected in parallel to NMOS transistor 24-1.

The gate width and gate length of each of the NMOS transistors (including NMOS transistors 24-1 and 24-2) forming the output transistor 24 are set equal to those of NMOS transistor 17. Also, NMOS transistor 17 and each of the NMOS transistors forming the output transistor 24 have the same layout and are formed in the same direction (e.g., the gate electrode, source region, and drain region are formed in the same direction).

This layout allows the NMOS transistors forming the step-down circuit to have the same characteristics. That is, since the process conditions and errors are the same, these NMOS transistors are formed to have the same fluctuation amount. This makes it possible to match the characteristics of the output transistor 24 and NMOS transistor 17 (or 20), and form a high-accuracy step-down circuit having small variations.

In this embodiment as has been described in detail above, the gate voltage of the output transistor 24 can be adjusted in accordance with the operation mode of the load circuit. Even when the operation modes of the load circuit are switched, therefore, the fluctuation in internal power supply voltage Vint can be suppressed.

Also, since the gate voltage of the output transistor 24 is adjusted in accordance with the load current flowing through the load circuit, a small-sized NMOS transistor for adjustment need only be added. Accordingly, the increase in circuit area can be suppressed even when this embodiment is applied. More specifically, the size of the step-down circuit can be made smaller than that when a plurality of output transistors are prepared.

Furthermore, the NMOS transistors forming the step-down circuit have the same characteristics. This makes it possible to form a high-accuracy step-down circuit having small variations.

Second Embodiment

In the second embodiment, an NMOS transistor 20 is connected or disconnected on the basis of an operation mode by using the gate terminal or drain terminal of NMOS transistor 20.

Figure 4:
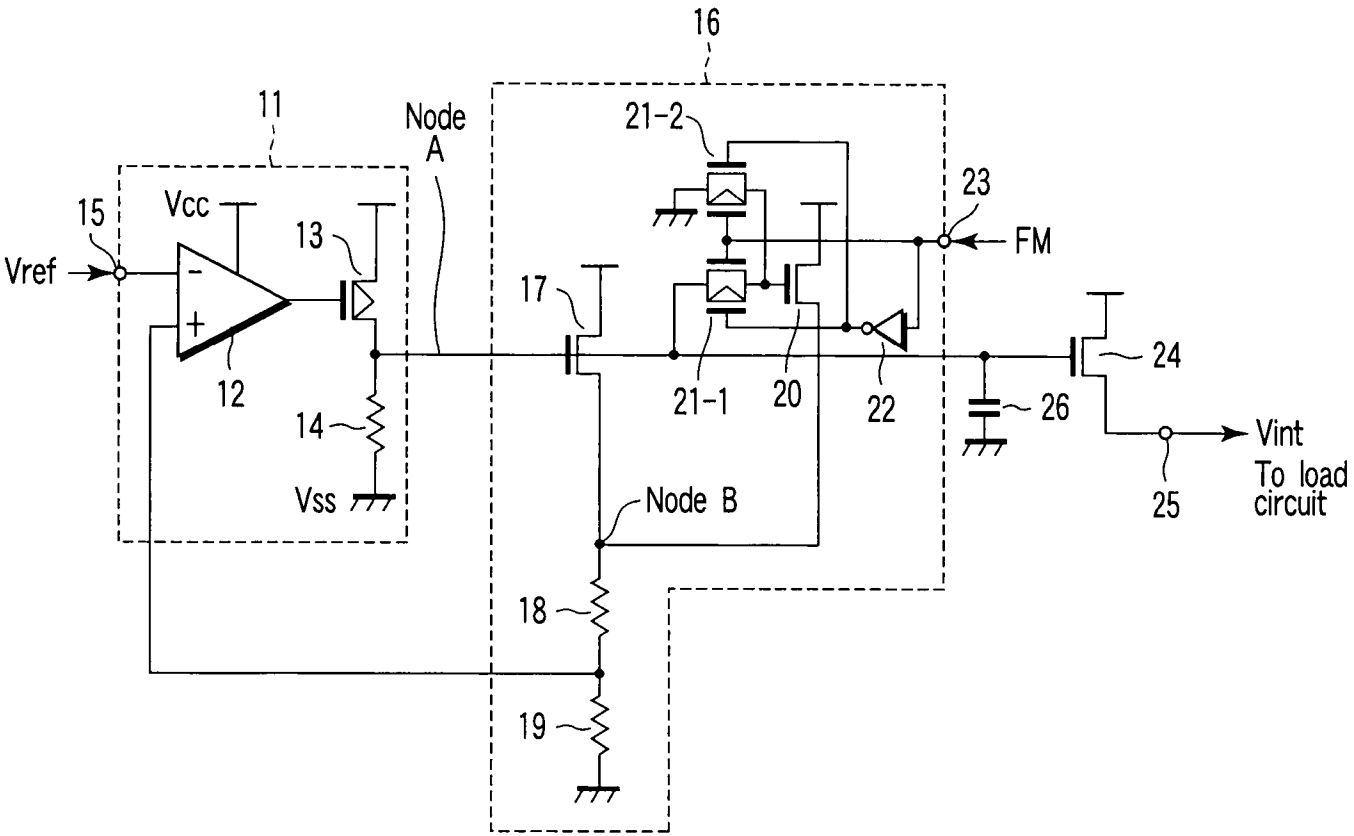
FIG. 4 is a circuit diagram illustrating the configuration of a step-down circuit according to the second embodiment of the present invention.

FIG. 4 is a circuit diagram illustrating the configuration of a step-down circuit according to the second embodiment of the present invention. NMOS transistor 20 is connected in parallel to an NMOS transistor 17. An external power supply voltage Vcc is applied to the drain terminal of NMOS transistor 20. The source terminal of NMOS transistor 20 is connected to node B.

The gate terminal of NMOS transistor 20 is connected to node A via a transfer gate 21-1. The gate terminal of NMOS transistor 20 is grounded via a transfer gate 21-2.

A switching signal FM is input to the gate terminal of an NMOS transistor of the transfer gate 21-1, and the gate terminal of a PMOS transistor of the transfer gate 21-2. Also, an inverted signal obtained by inverting the switching signal FM by an inverter circuit 22 is input to the gate terminal of a PMOS transistor of the transfer gate 21-1, and the gate terminal of an NMOS transistor of the transfer gate 21-2. Therefore, when the switching signal FM is high, the transfer gate 21-1 is on, and the transfer gate 21-2 is off. When the switching signal FM is low, the transfer gate 21-1 is off, and the transfer gate 21-2 is on.

The operation of a monitor circuit 16 configured as above will be explained below. In an operation mode in which a load current flowing through a load circuit is large, the switching signal FM is made low. In this case, the transfer gate 21-1 is turned off, and the transfer gate 21-2 is turned on. Since, therefore, a ground voltage Vss is applied to the gate terminal of NMOS transistor 20, NMOS transistor 20 is turned off. As a consequence, NMOS transistor 17 is the only transistor whose gate is connected to node A. That is, the size of the NMOS transistor for adjusting the voltage of node A decreases, so the voltage of node A rises. This increases the current supply capability of an output transistor 24.

On the other hand, in an operation mode in which the load current flowing through the load circuit is small, the switching signal FM is made high. In this case, the transfer gate 21-1 is turned on, and the transfer gate 21-2 is turned off. Accordingly, the gate terminal of NMOS transistor 20 is connected to node A. As a result, NMOS transistors 17 and 20 are transistors whose gate terminals are connected to node A. That is, the size of the NMOS transistor for adjusting the voltage of node A increases, so the voltage of node A lowers. This decreases the current supply capability of the output transistor 24.

Figure 5:
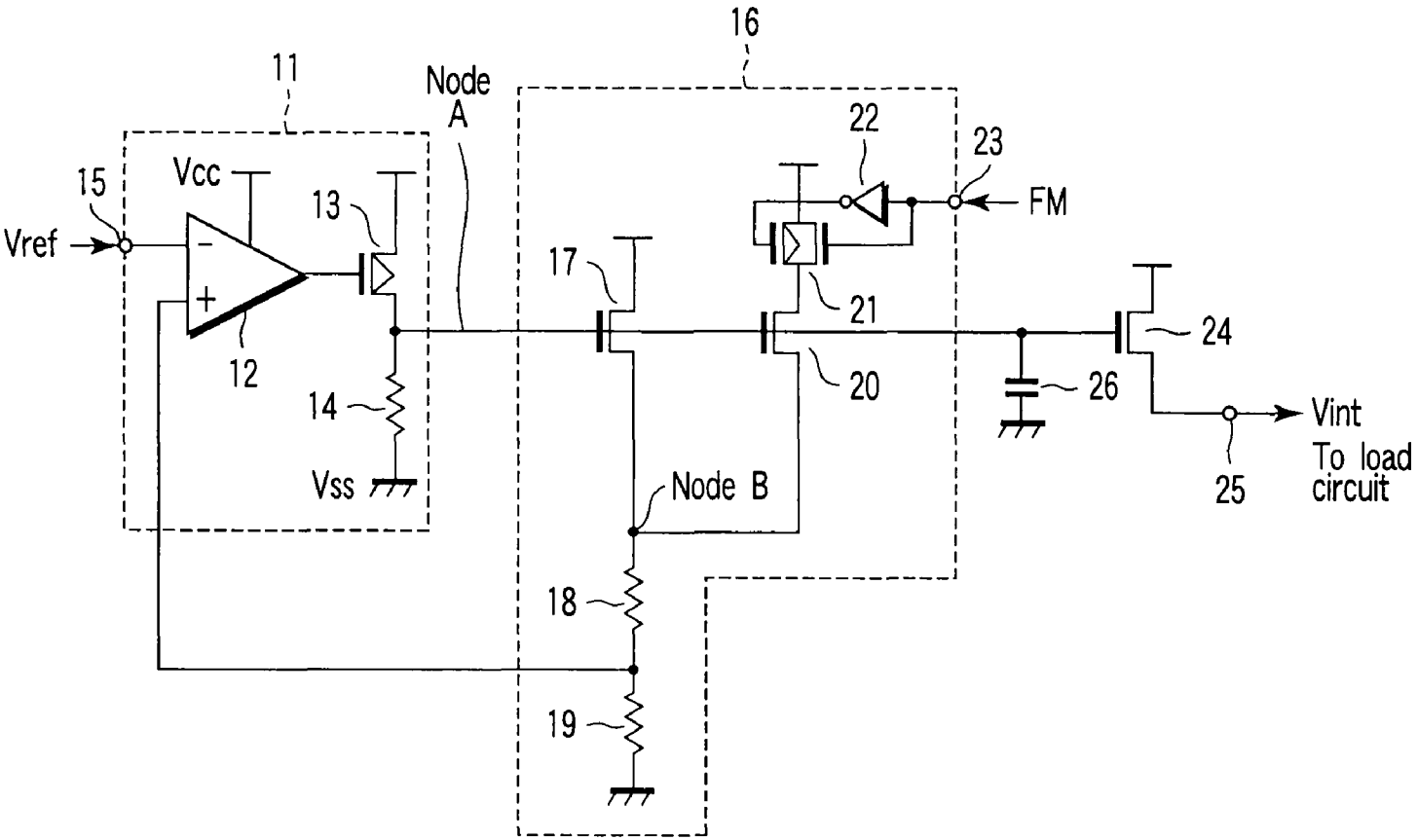
FIG. 5 is a circuit diagram illustrating another configuration of the step-down circuit according to the second embodiment.

The same effects as in the first embodiment can be obtained even when the step-down circuit is thus configured. Note that as a means for changing the size of the NMOS transistor for adjusting the voltage of node A, it is also possible to switch the connections between the drain terminal of NMOS transistor 20 and the external power supply voltage Vcc. FIG. 5 is a circuit diagram illustrating another configuration of the step-down circuit.

The external power supply voltage Vcc is applied to the drain terminal of NMOS transistor 20 via a transfer gate 21. The source terminal of NMOS transistor 20 is connected to node B. The gate terminal of NMOS transistor 20 is connected to node A.

The switching signal FM is input to the gate terminal of an NMOS transistor of the transfer gate 21. Also, the inverted signal obtained by inverting the switching signal FM by the inverter circuit 22 is input to the gate terminal of a PMOS transistor of the transfer gate 21. Accordingly, the transfer gate 21 is on when the switching signal FM is high, and is off when the switching signal FM is low.

In the monitor circuit 16 configured as above, it is possible to switch the application and interruption of the external power supply voltage Vcc to the drain terminal of NMOS transistor 20 by the switching signal FM. This makes it possible to change the size of the NMOS transistor for adjusting the voltage of node A. The same effects as in the first embodiment can be obtained even when the step-down circuit is thus configured.

Third Embodiment

In the third embodiment, an assisting circuit for rapidly setting the voltage of node A is connected to node A to raise the speed of the operation of applying an internal power supply voltage Vint in a step-down circuit.

Figure 6:
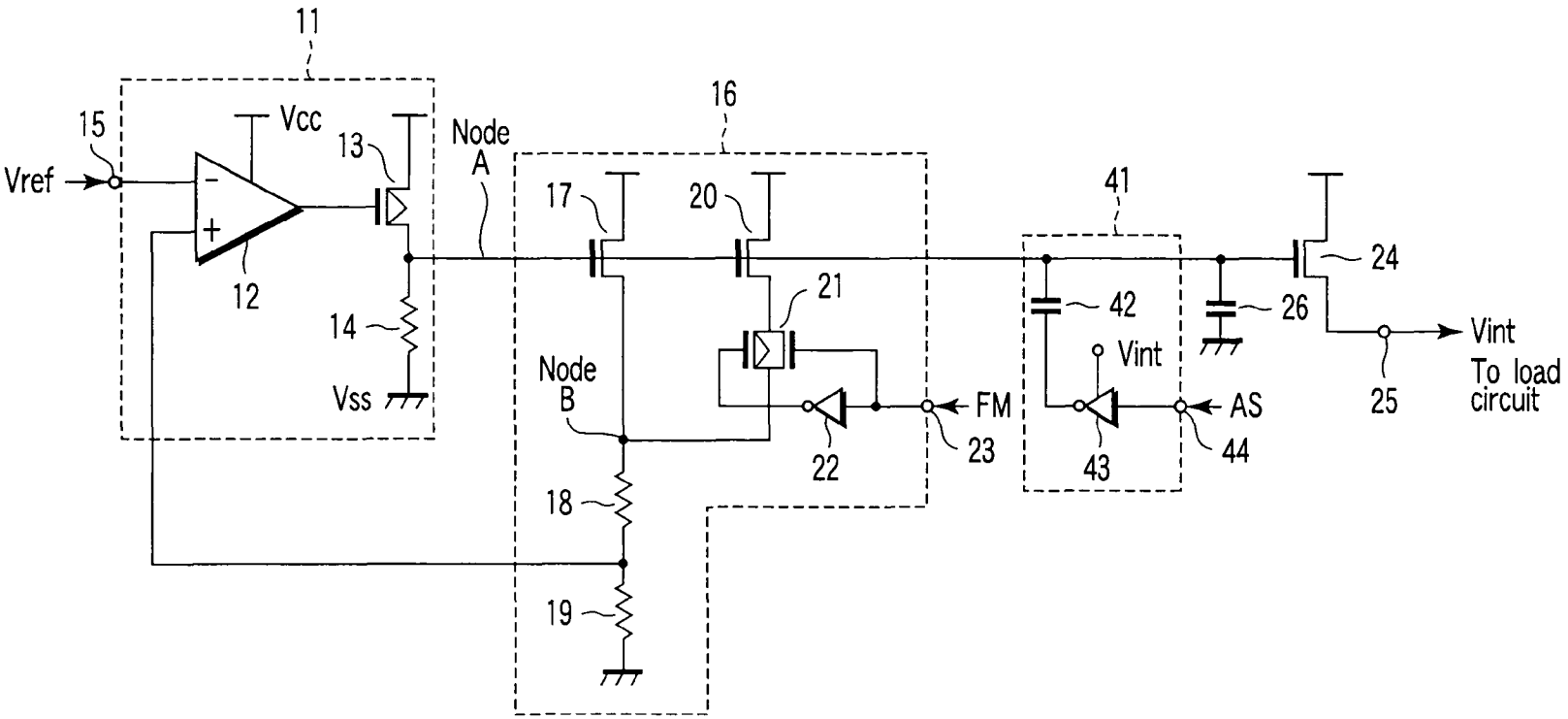
FIG. 6 is a circuit diagram illustrating the configuration of a step-down circuit according to the third embodiment of the present invention.

FIG. 6 is a circuit diagram illustrating the configuration of the step-down circuit according to the third embodiment of the present invention. This step-down circuit comprises an assisting circuit 41. The size of an output transistor 24 of the step-down circuit is a few mm to a few cm in many cases in order to supply a large load current. When a capacitor 26 for voltage stabilization is additionally connected to node A, therefore, it takes a long time to change the voltage of node A. The assisting circuit 41 has a function of forcedly raising the voltage of node A to a predetermined voltage, or forcedly stepping down the voltage of node A to a predetermined voltage.

The assisting circuit 41 comprises a capacitor 42, inverter circuit 43, and terminal 44. An assist signal AS as an external control signal is supplied to the terminal 44. The assist signal AS is connected to one electrode of the capacitor 42 via the inverter circuit 43. The other electrode of the capacitor 42 is connected to node A.

Also, the internal power supply voltage Vint and a ground voltage Vss are used as the power supply of the inverter circuit 43. That is, the voltages independent of an external power supply voltage Vcc are used as the power supply of the inverter circuit 43. The rest of the arrangement is the same as that of the first embodiment.

The operation of the step-down circuit configured as above will be explained below. When raising the voltage of node A, the assist signal SA is made low. Therefore, the internal power supply voltage Vint is applied to the electrode of the capacitor 42. As a consequence, the voltage of node A rises.

When stepping down the voltage of node A, the assist signal SA is made high. Accordingly, the ground voltage Vss is applied to the electrode of the capacitor 42. As a result, the voltage of node A is stepped down. A feedback circuit 11 and monitor circuit 16 finally adjust the level of node A.

In this embodiment as has been described in detail above, the voltage of node A can be rapidly changed because the assisting circuit 41 is added. This makes it possible to raise the speed of the operation of applying the internal power supply voltage Vint in the step-down circuit. Also, the voltages independent of the external power supply voltage Vcc are used as the power supply of the assisting circuit 41. Therefore, the assist amount of the voltage of node A can be held constant. Note that this embodiment is of course applicable to the second embodiment as well.

In each embodiment, an NMOS transistor is used as the output transistor 24. However, a PMOS transistor may also be used as the output transistor 24. In this case, the same effects as in the above embodiments can be obtained by changing the polarities of the power supply voltages and node voltages.

Note that each embodiment has been explained by using MOS transistors, but metal insulator semiconductor (MIS) transistors may also be used.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A step-down circuit which generates a second power supply lower than a first power supply, comprising:

an output terminal connected to a load circuit;

an output transistor connected between the first power supply and the output terminal, and having a gate terminal connected to a first node;

a monitor transistor connected between the first power supply and a second node, and having a gate terminal connected to the first node; and a feedback circuit which sets a gate voltage of the output transistor in accordance with a difference between a voltage obtained by dividing a voltage of the second node and a reference voltage, wherein a size of the monitor transistor is changed in accordance with an operation mode of the load circuit.

2. The circuit according to claim 1, wherein the monitor transistor comprises a first MOS transistor and a second MOS transistor, and each of the first MOS transistor and the second MOS transistor is connected between the first power supply and the second node, and has a gate terminal connected to the first node.

3. The circuit according to claim 2, further comprising a switching element which switches a connected state/disconnected state of the second MOS transistor and the second node in accordance with the operation mode.

4. The circuit according to claim 3, wherein the switching element controls the connected state/disconnected state on the basis of a signal which changes the operation mode.

5. The circuit according to claim 2, further comprising a switching element which switches a connected state/disconnected state of the gate terminal of the second MOS transistor and the first node in accordance with the operation mode.

6. The circuit according to claim 5, wherein the switching element applies an off voltage to the gate terminal of the second MOS transistor in the disconnected state.

7. The circuit according to claim 2, further comprising a switching element which switches a connected state/disconnected state of the second MOS transistor and the first power supply in accordance with the operation mode.

8. The circuit according to claim 2, wherein the first MOS transistor and the second MOS transistor have the same size.

9. The circuit according to claim 8, wherein the output transistor comprises a plurality of third MOS transistors, and a size of each third MOS transistor is the same as that of one of the first MOS transistor and the second MOS transistor.

10. The circuit according to claim 9, wherein the first MOS transistor, the second MOS transistor, and the third MOS transistor have the same layout.

11. The circuit according to claim 10, wherein gate electrodes, source regions, and drain regions of the first MOS transistor, the second MOS transistor, and the third MOS transistor are arranged in the same direction.

12. The circuit according to claim 1, further comprising a first resistor and a second resistor which divide a voltage of the second node and are connected in series between the second node and a ground terminal.

13. The circuit according to claim 1, further comprising a capacitor having a first electrode connected to the first node, and a grounded second electrode.

14. The circuit according to claim 1, further comprising an assisting circuit which performs one of an operation of forcedly raising a voltage of the first node and an operation of forcedly stepping down the voltage of the first node, in accordance with the operation mode.

15. The circuit according to claim 14, wherein the assisting circuit comprises a capacitor having a first electrode connected to the first node, and a second electrode which receives a signal which changes the operation mode.

16. The circuit according to claim 1, wherein the operation mode includes a first mode, and a second mode in which current consumption is smaller than that in the first mode.

17. The circuit according to claim 1, wherein the feedback circuit comprises:

a differential amplifier which receives the reference voltage and the divided voltage; and a MOS transistor having a source terminal connected to the first power supply, a gate terminal connected to an output of the differential amplifier, and a drain terminal grounded via a resistor.

* * * * *